United States Patent [19]

Kumano

[11] 4,334,453

[45] Jun. 15, 1982

[54] KEYBOARD MUSICAL INSTRUMENT WITH REMOVABLE BOX LEG

[75] Inventor: Shinji Kumano, Hamamatsu, Japan

[73] Assignee: Nippon Gakki Seizo Kabushiki Kaisha, Hamamatsu, Japan

[21] Appl. No.: 125,802

[22] Filed: Feb. 28, 1980

[30] Foreign Application Priority Data

Mar. 9, 1979 [JP] Japan ..... 54/29214[U]

[51] Int. Cl.[3] ..... G10C 3/02

[52] U.S. Cl. ..... 84/177

[58] Field of Search ..... 84/174, 176, 177, 178, 84/179, 180, 181, 182, 183

[56] References Cited

U.S. PATENT DOCUMENTS

| | | | |
|---|---|---|---|
| 1,084,088 | 1/1914 | Hopphan | 84/176 |
| 2,174,671 | 10/1939 | Sauerland | 84/177 |
| 2,249,978 | 7/1941 | Pfaff | 84/177 |
| 2,505,805 | 5/1950 | Stein | 84/177 |
| 3,608,415 | 9/1971 | Muraki | 84/177 |

FOREIGN PATENT DOCUMENTS

| | | | |
|---|---|---|---|
| 415988 | 7/1925 | Fed. Rep. of Germany | 84/177 |

*Primary Examiner*—L. T. Hix
*Assistant Examiner*—Alan Mathews
*Attorney, Agent, or Firm*—Townsend and Townsend

[57] ABSTRACT

A keyboard musical instrument comprises a main body accommodating a keyboard and electronic parts, and a box-shaped leg structure for supporting the main body and including front, back and two side boards for supporting the body. The leg structure is so constructed that the front and back boards are removably mounted to the main body and the two side boards as well, and that the side boards are mounted to the main body removably or such that they can be folded down toward the main body.

12 Claims, 14 Drawing Figures

FIG. 10A
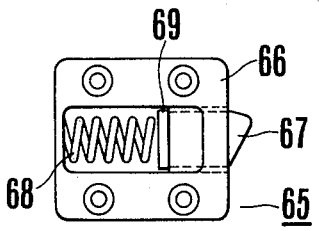
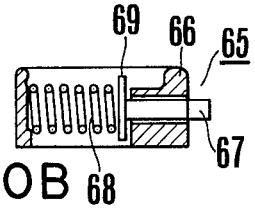
FIG. 10B
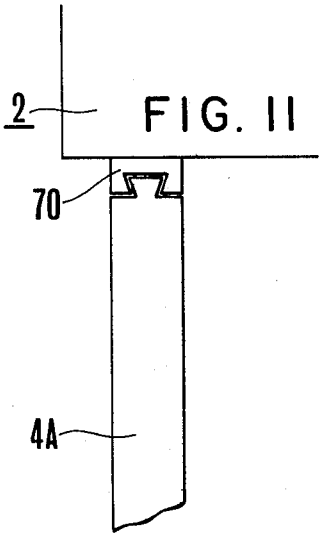
FIG. 11
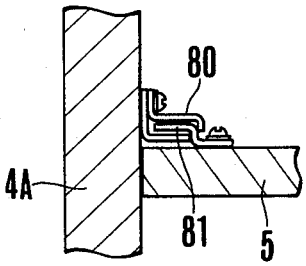
FIG. 12

KEYBOARD MUSICAL INSTRUMENT WITH REMOVABLE BOX LEG

BACKGROUND OF THE INVENTION

The present invention relates to keyboard musical instruments, and more particularly to a keyboard musical instrument of the type which comprises a main body having a structure containing a keyboard portion and electronic parts as well which work in combination with the keyboard portion, to produce a musical tone, and a box-shaped leg comprising a spaced pair of side boards parallelly arranged for supporting the main body, and spaced front and back boards mounted between the side boards and parallelly arranged.

As musical instruments having such construction, there are electronic organs for home use, musical instruments for a group teaching system or the like. When an instrument of this type is transported, an entire package for the instrument is required, so that the package itself must be relatively large, thus reducing transportation efficiency and even increasing the possibility of damaging the instrument. In prior art instruments like the above, the two side boards, i.e. the front and back boards for supporting the instrument body are fastened to the bottom of the body by means of L-shaped metal fittings screwed thereon. Therefore, the assembling of the instrument is apt to be relatively complicated.

SUMMARY OF THE INVENTION

It is therefore a major object of the present invention to provide a keyboard musical instrument, having a boxshaped leg which can be removed and/or collapsed so that the transportation efficiency of the unit can be highly improved.

Another object of the present invention is to provide a keyboard musical instrument, in which the structure for setting up side, front and back boards supporting the instrument main body is so improved that their assembly and disassembly is highly facilitated.

In order to attain the above objects, according to one aspect of the present invention, there is provided a keyboard musical instrument comprising an instrument main body and a leg portion for supporting the main body, the main body having a box-shaped construction to include a keyboard portion and electronic components used in combination with the keyboard portion, the leg portion including a spaced pair of side boards for supporting the main body, which are arranged in parallel, mutually spaced front and back board bridging the side boards and being arranged in parallel, and connecting means which are mounted at the respective corners created between board members forming the leg portion and adapted to be manually assembled and disassembled. In the preferred embodiment, the side boards are connected to the main body by means of hinges or dovetail joints.

BRIEF DESCRIPTION OF THE DRAWINGS

In the accompanying drawings:

FIGS. 10A and 10B are a plan view and a longitudinal sectional of the back lock blocks 65 shown in FIG. 8, respectively;

FIG. 11 is a side elevation showing another structure connecting the main body with the side board; and FIG. 12 is a plan view partly in section showing another structure for connecting the back board to the main body.

DESCRIPTION OF THE PREFERRED EMBODIMENTS

The present invention will now be described in connection with the embodiments thereof with reference to the accompanying drawings.

Figure 1:
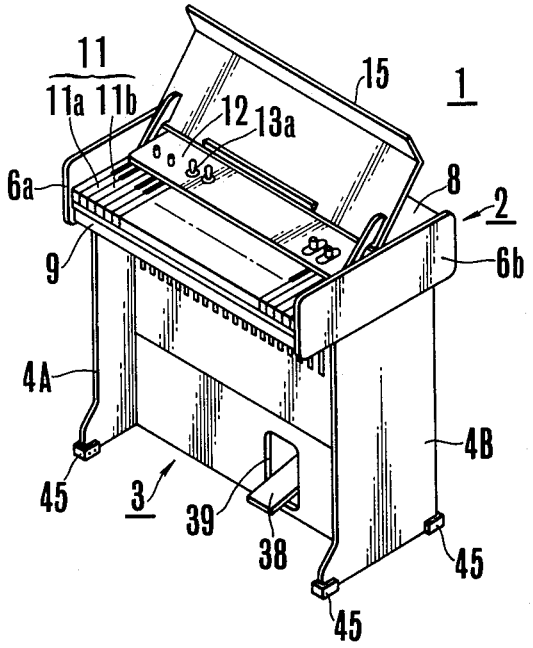
FIG. 1 is a perspective view showing one embodiment of a keyboard musical instrument according to the present invention.
Figure 2:
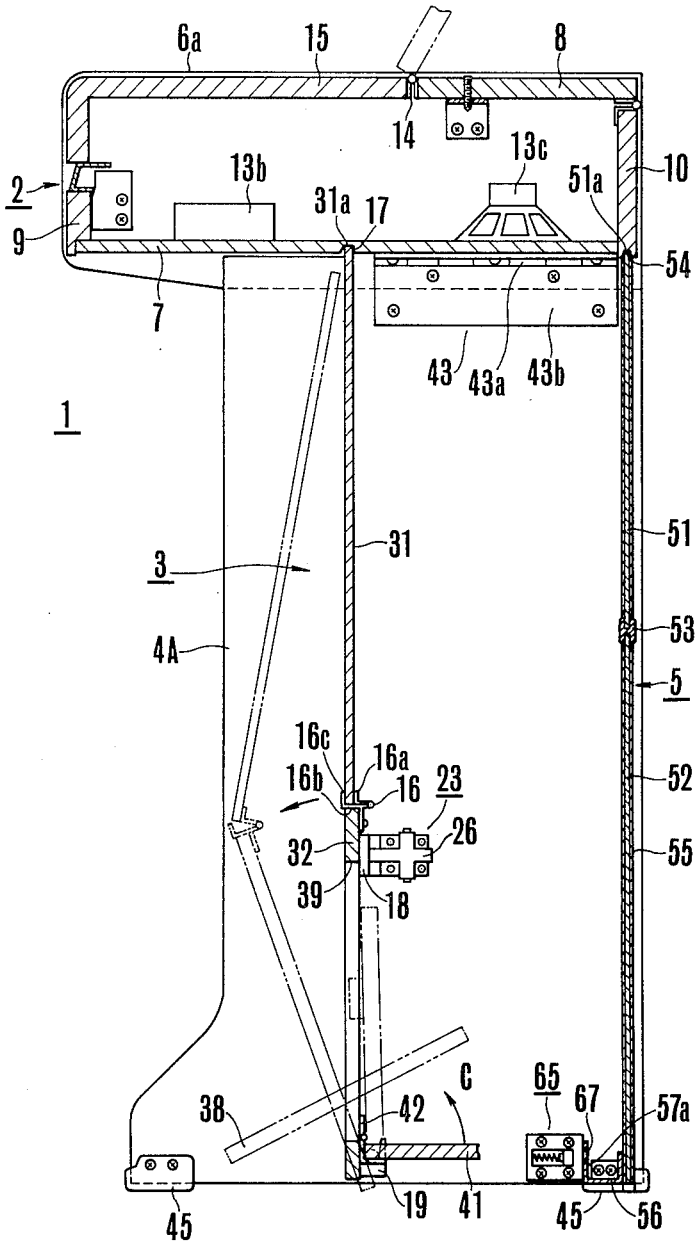
FIG. 2 is a longitudinal sectional view of the instrument of FIG. 1.

FIG. 1 is a perspective view showing one embodiment of a keyboard musical instrument according to the present invention. FIG. 2 is a longitudinal sectional view of the instrument of FIG. 1.

As shown in these figures, the instrument, which is generally indicated with a reference numeral 1, is constructed to comprise a main body 2 including a keyboard, a front board 3, side boards 4A and 4B, and a back board 5, which are assembled together in box shape to constitute leg portion for stably supporting the main body 2.

This body 2 if formed in a box shape having an opened upper front end portion, by using a pair of left and right side boards **6*a* and 6*b*, a shelf board 7, a top board 8, a front rail 9 and a back board 10. The main body 2 thus formed is further equipped with a manual keyboard 11, which is composed of a plurality of keys 11*a* and 11*b* arranged in the open front end portion, a variety of electronic manipulators 13*a* such as a rotary variable resistor, a slide variable resistor, a push button switch and so forth, which are mounted on a control board 12 arranged above the back end of the keyboard 11, electronic components 13*b* such as a circuit unit to work in combination with said keys and electronic manipulators 13*a*, and a speaker 13*c*. At the front end portion of the top board 8, there is arranged a keyboard cover 15 which has its one end hinged swingingly to the top board 8 by means of hinges 14. Thus, the open front end portion of the instrument main body 2 is covered with the keyboard cover 15, so that the keyboard 11 and electronic manipulators 13*a*** are protected from damage by an external force.

Incidentally, the main body 2 may have the same construction as similar portions of various conventional keyboard instruments.

Figure 3:
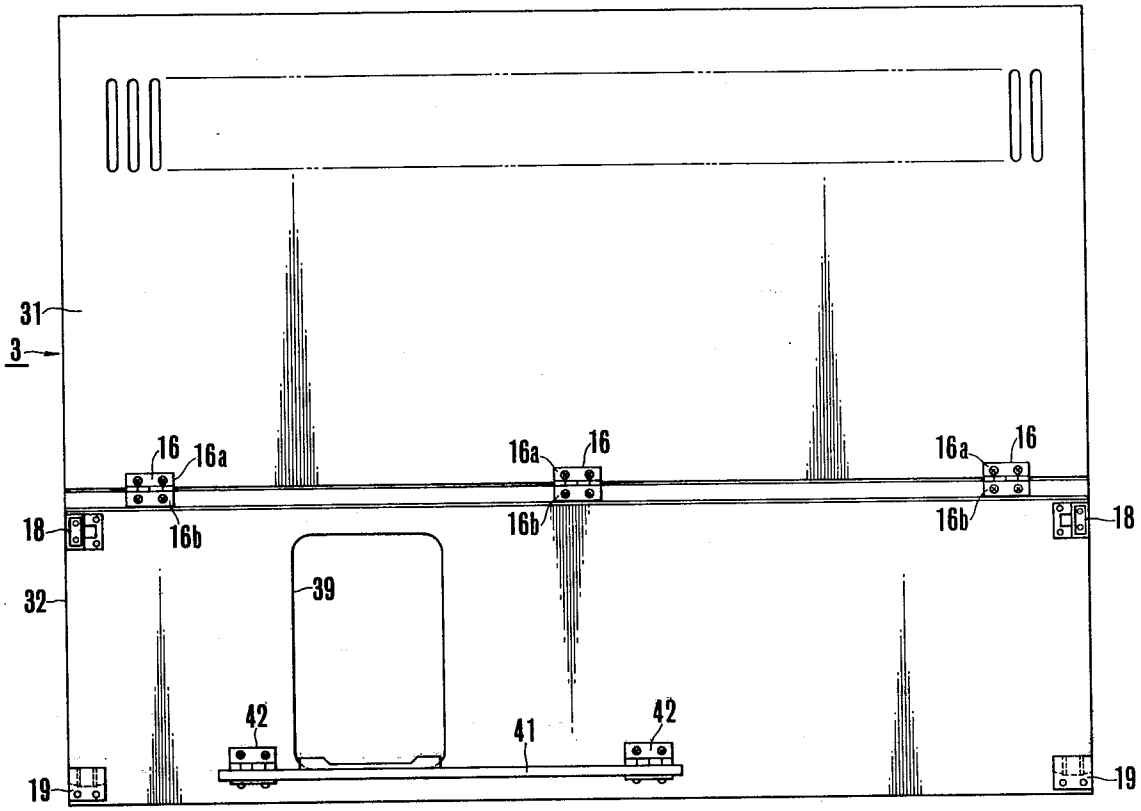
FIG. 3 is a back elevational view of a front board shown in FIG. 1.
Figure 4:
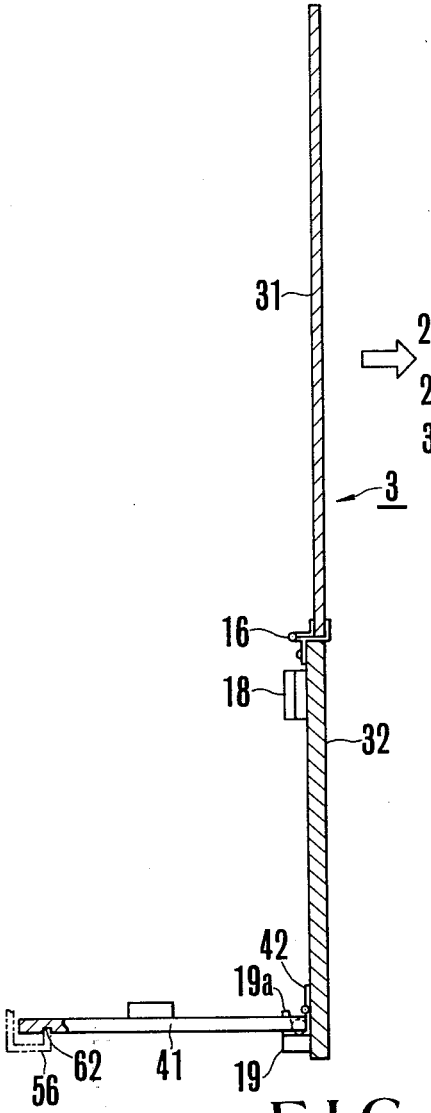
FIG. 4 is a longitudinal sectional view of the front board shown in FIG. 1.

The front board 3 constituting the leg portions of the main body 2 is divided along its horizontal intermediate line, as shown in FIGS. 2 to 4, into upper and lower front boards 31 and 32 which are connected by means of a plurality of (three in FIG. 3) hinges 16 such that they can be folded forward, as shown in double-dotted lines in FIG. 2. The front board 3 is arranged to stand off slightly toward the front side of the body 2 in view of the vertical center line of the paired side boards 4A and 4B which are connected to both bottom end portions of the main body 2 in such a manner that they may be folded beneath the bottom of the main body. Front board 3 is removably attached to the body 2 and to the side boards 4A and 4B as well. In other words, the shelf board 7 or the bottom board constituting the main body 2 has its under side with an engagement portion 17 which is formed in a grooved shape elongating in the longitudinal direction, i.e., in the right to left direction of the shelf board 7 and is adapted to receive the upper end 31*a* of the upper front board 31. On the inner side of the lower front board 32 and at the upper and lower corner portions of the same, there are fixed a pair of right and left plastic lock blocks 18 and a pair of right and left plastic hooks 19 by using screws respectively. Now, looking at FIG. 5, it is seen that the lock block 18 adjacent to the side board 4A engages with a lock unit 23 mounted on the side board 4A. In this figure, the lock block 18 is formed generally into a rectangular shape, and its portion in the vicinity of the side board 4A is made to protrude from an end portion 21 which is located apart from the side board 4A. The protrusion 20 thus formed has its crest formed with an engagement recess 20*a* which is tapered depthwise into a converging shape. As a result, an annular protrusion 22 is formed around the engagement recess 20*a*, and a through hole 21*a* is formed at the connecting portion between the annular protrusion 22 and the end portion 21. The through hole 21*a* has its upper end halfcovered with an engagement protrusion 22*a* which is formed on the stem portion of the protrusion 22 such that it protrudes in a manner to confront the through hole 21*a*. The engagement protrusion 22*a* is further formed with a counter-taper portion 22*b* which is tapered in a converging shape deeply into the through hole 21*a*. The lock units 23 are fixed to the inner side of the side board 4A in a manner to face the lock blocks 18. Each of the lock units 23 is constructed to include a plastic block 24 which is fixed to the side board 4A by means of screws, a metal hook 26 which is formed with a U-shaped bent portion 26*a* and which is supported rotatably on that block 24 by means of a pin 25, a spring 28 which is mounted in the recess 27 formed in the block 24 thereby always biasing the hook 26 in the clockwise direction, as viewed in FIG. 5, and a frustoconical protrusion 29 which is integrally formed to protrude from the front end of the block 24 in a manner to face the engagement recess 20*a* of the lock block 18.

Figure 6:
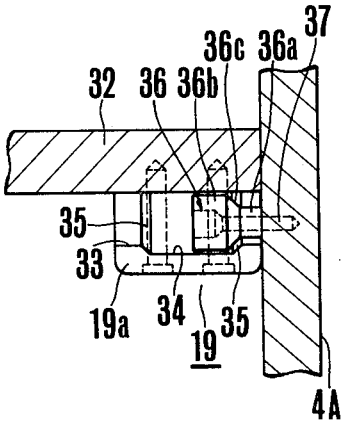
FIG. 6 is a plan view partly in section showing the engagement between hooks 19 connecting the side board with the lower portion of the lower front board and bushes 36.

On the other hand, each of the hooks 19 is formed, as shown in FIGS. 4 and 6, generally in such a shape like a letter "L" that is fixed to the lower front board 32 by using screws and is formed with an engagement recess 34 at the center portion of the inner sides 33 of a vertical member 19*a* which is positioned to face the lower front board 32 thereby to form a U-shaped groove together with the same. The engagement recess 34 has both sides merging into the inner sides 33 of the vertical member 19 through inclined sides 35. Indicated by a reference numeral 36 is a plastic bushing which is fixed by a screw 37 to the inner side of the side board 4A in a manner corresponding to hook 19. The busing 36 thus fixed is constructed to include a stem portion 36*a* which has a smaller outside diameter than the gap between the inner sides 33 of hook 19 and the lower front board 32, an engagement head 36*b* which has a slightly smaller outer diameter than the gap between the bottom wall of the engagement recess 34 of the hook 19 and the lower front board 32, and a counter-taper portion 6*c* which is formed at the merging portion between the stem portion 36*a* and the engagement head 36*b* in a manner to correspond to the inclined sides 35 of the aforementioned hook 19. The members for connecting the other side board 4B and the front board assembly 3 are made in the same manner as those thus far described for the side board 4A.

Figure 5:
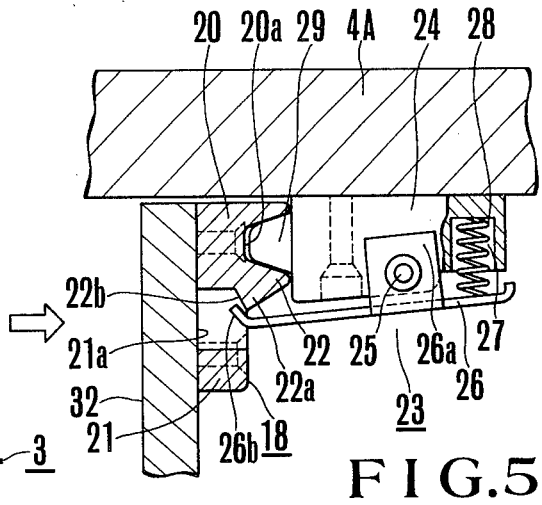
FIG. 5 is a plan view partly in section showing the engagement between lock units 23 connecting the side board with the upper portion of a lower front board and the front board lock blocks 18.

Thus, in case it is intended to set up the front board 3 to the main body 2 and the side boards 4A and 4B, the hooks 19 are brought, as shown in FIG. 6, into engagement with the bushings 36 while keeping the upper and lower front boards 31 and 32 under forward folded conditions, as shown in the double-dotted lines in FIG. 2. Then, the upper and lower front boards 31 and 32 are pushed backward to get them straight, while keeping the above engagement conditions, until the upper end 31*a* of the upper front board 31 is fitted in the groove like engagement portion 17 of the shelf board 7. As a result, the protrusions 29 of the front lock units 23 engage with the holes 20*a* of the lock blocks 8, as shown in FIG. 5, and the generally hook-shaped engagement portions 26*b* formed at the leading end of the hooks 26 are inserted into the holes 21*a*, until they engage with the engagement protrusions 22*a* of the annular protrusion 22, so that the front board 3 is mounted removably to the main body 2 and the side boards 4A and 4B while being prevented from moving in the vertical, the right to left, and back and forth directions. When the engagement portions 26*b* are brought into engagement with the counter-taper portions 22*b* which are formed in the engagement protrusions 22*a*, the resultant engagements are more strengthened by vibrations due to the movements or transportation of the instrument after the side boards 4A and 4B and the lower front board 32 are jointed.

Moreover, each of the hinges 16 connecting the aforementioned upper and lower front boards 31 and 32 are constructed as shown in FIG. 2, to include a hinge member 16*a* which is formed generally into a shape of letter "L" and which is fixed to the inner side of the lower end portion of the upper front board 31, a hinge member 16*b* which is formed generally into the shape depicted and which is fixed to the upper end portion of the lower front board 32 at its downward extension, and a vertical member 16*c* which is disposed to extend upwardly of the hinge member 16*b* and which is in abutment against the outer side (or the side facing the organ player) of the lower end portion of the upper front board 31. Thus, the upper and lower front boards 31 and 32 are held in a single flat plane while being prevented from being folded rearward.

On the other hand, the aforementioned lower front board 32 is formed at its righthand portion with a pedal opening 39 through which an expression pedal 38 is mounted. Moreover, a bottom board 41 which will be described in more detail is pivotally connected at its one end to the righthand back side of the lower end of the lower front board 32 by means of two hinges 42.

Figure 7:
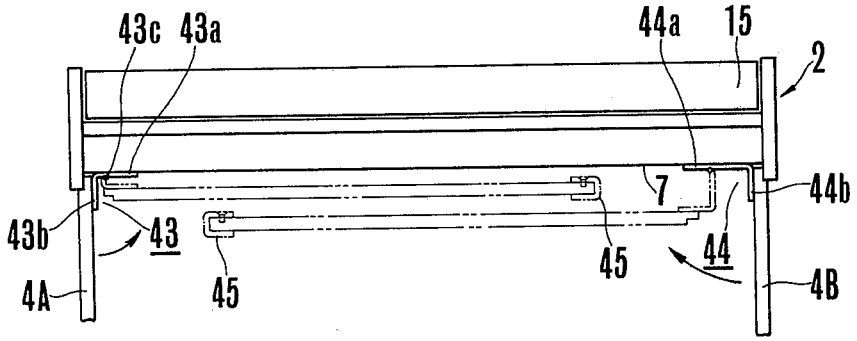
FIG. 7 is a diagrammatical representation for use in explaining the straight and folded states of the side boards in the instrument.
Figure 8:
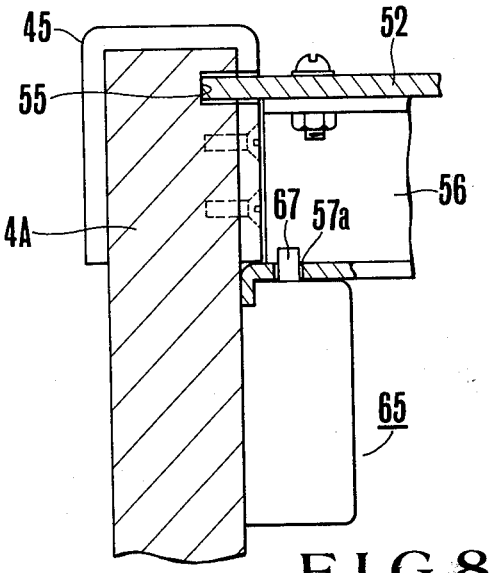
FIG. 8 is an enlarged plan view partly in section showing the engagement between back board lock blocks 65 and rail 56 shown in FIG. 4.

The paired side boards 4A and 4B are connected, as shown in FIG. 7, at their upper ends to both end portions of the lower sise of the shelf board 7 through hinges 43 and 44 in the manner thus far described, so that they can be folded toward the bottom portion of the main body 2 by the actions of the hinges 43 and 44, as shown in double-dotted lines. Namely the hinge 43 at the lefthand side, as viewed toward the main body 2, is constructed to include a flat hinge member 43*a* which is fixed to the shelf board 7, and a hinge member 43*b* which is fixed to the lefthand side board 4A and which is folded generally into the shape of the letter "L" in the vicinity of a joint portion 43*c*. As a result, the lefthand side board 4A is folded below the lower side of the shelf board 7 by the swinging motions of the hinge member 43*b*. On the other hand, the righthand hinge 44 is so constructed that its flat hinge member 44*a* is fixed to the shelf board 7 more internally than the hinge member 43*a* of the hinge 43 and that its hinge member 44*b* affixed to the righthand side board 4B is made longer than the hinge member 43*b* and is bent at its center portion generally into the shape of the letter "L". As a result, if the hinge member 44*b* thus made is swung into the position shown in the double-dotted lines, the righthand side board 4B is folded below the lefthand side board 4A at a suitable spacing therefrom, thereby the side boards can be prevented from interfering with each other. Moreover, each of the side boards 4A and 4B has its lower end, to which two non-slip fittings 45 made of a synthetic resin or the like are fixed at its front and back ends. The non-slip fittings 45 thus fixed are brought, when the side board 4A and 4B are folded, into abutment against the shelf board 7 and the upper side board 4A respectively, so that suitable spacing can be retained between the shelf board 7 and the side board 4A and between the side boards 4A and 4B, thereby preventing the side boards 4A and 4B from being damaged.

The back board 5 is a three-layer pressed board in this example and has a two-part construction similar to that of the front board 3 and is constructed, as shown in FIG. 2, partly to include an upper back board 51 and a lower back board 52 which is joined at its upper end through a joint having an H-shaped cross-section which is fixed to the lower end of the upper back board 51, and partly to the attached removable to the main body 2 and the inner sides of the back ends of the side boards 4A and 4B. That is, the back board 10 has at its lower end an engagement portion 54 having the shape of an elongated groove extending in the longitudinal direction of the back board 10 so that the upper end 51*a* of the upper back board 51 is fited in this groove-like engagement portion 54. On the other hand, the side boards 4A and 4B have at the inner sides of their rear end portions engagement portions 55 having a shape of an elongated groove extending in the vertical directions so that the back board assembly 5 can have both side end portions slidably fitted in those groove like engagement portions 55. On the inner side of the lower end portion of the lower back board 52, there is fixed a back board rail 56 having a general channel shape such that its opening is directed upward. The back board rail 56 thus fixed has at both end portions engagement openings 57*a* and 57*b* and also has at the righthand side from the center thereof, as viewed in FIG. 9, a pair of bottom board hooks 58*a* and 58*b* corresponding to the bottom board 41. The bottom board hooks 58*a* and 58*b* are swingingly supported at their lower ends by means of pins 59 which are mounted in the back board rail 56 and have hook-shaped engagement portions 60 on the inner side of the upwardly extending end portion of the back board rail 56. The bottom board hooks 58*a* and 58*b* are always biased to swing inwardly, as shown at arrows A and B, by the actions of coil springs 61, which are mounted on the pins 59, so that back end portion of the bottom board 41 is clamped and forced into contact with the upper end of the bottom board rail 56 by the force of the springs 61. As shown in FIG. 4, the bottom board 41 has at the lower side of its back end portion, a longitudinally extending long groove 62, in which the upper end of the bottom board rail 56 is fitted.

On the other hand, back board lock units 65 are fixed to the lower portions of the inner side of the back end portion of the side boards 4A and 4B, respectively, in a manner to face the engagement openings 57*a* and 57*b* of the back board rail 56. Each of the back board lock units 65 has, as shown in FIG. 10, a housing 66, a lock bolt 67 which is received in the housing 66 in a manner to move back and forth, has its leading end protruding backward from the housing 66, and is cut obliequely at its upper and lower sides, and a spring 68 which is received in the housing 66, thereby urging the bolt in the rightward direction, as viewed in FIG. 10. As a result, when the back board assembly 5 is inserted from the instrument 1 along the engagement portion 55 of the side boards 4A and 4B, the bolts 67 come engage with engagement openings 57*a* and 57*b* of the rear board rail 56 respectively, so that the back board 5 is attached to the main body 2 and the side boards 4A and 4B while being prevented from falling down and from moving back and forth and to the right and left by the actions of the groove like engagement portion 54 of the back board 10 and the engagement portion 55 of the side boards 4A and 4B.

Now, the disassembling procedures of the keyboard musical instrument 1 having the construction described thus far will be described.

1st step: The instrument 1 is placed upside down with the bottom board 41 being positioned above under the condition having the keyboard cover 15 closed.

Figure 9B:
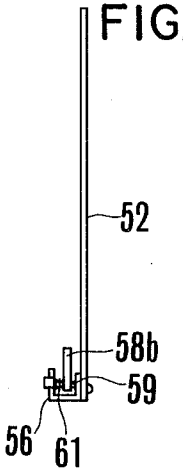
FIGS. 9A and 9B are a plan view and a side elevation showing a lower back board, respectively.
Figure 9A:
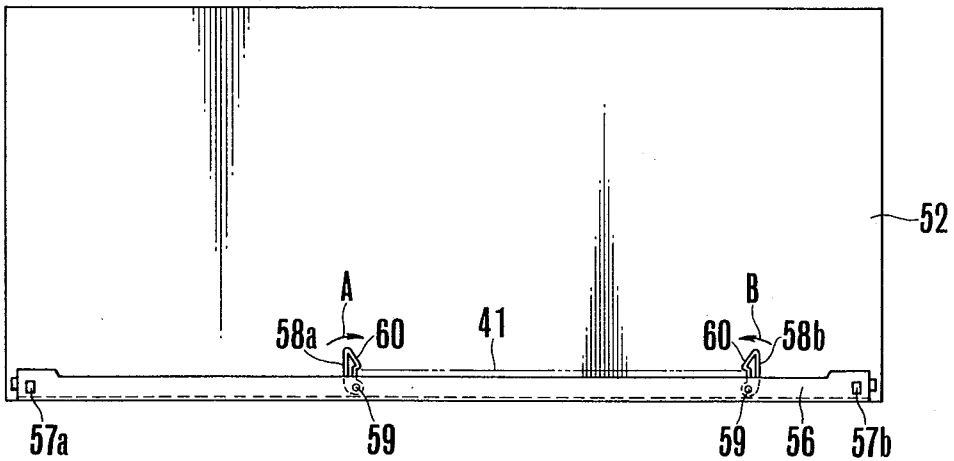

2nd Step: As shown in FIG. 9, the bottom board hooks 58*a* and 58*b* of the lower back board 52 are swung outward against the actions of the coil springs 61 so that they are disassembled from the bottom board 41, and the bottom board 41 is swung in the direction of arrow C, as shown in FIG. 2, about the joint portion of the lower front board 32 so that its back end portion is disassembled from the bottom board rail 56.

3rd Step: The hooks 26 of the front board lock units 23 are swung in the counter-clockwise direction, as shown in FIG. 5, against the forces of the springs 28 so that the engagement portions 26*a* of said hooks 26 are disengaged from the engagement portions 22*a* of the lock blocks 18.

4th Step: The front board assembly 3 is extracted in the forward direction, as shown in the double-dotted lines in FIG. 2, so that the upper end 31*a* of the upper front board 31 is disengaged from the engagement portion 17 of the shelf board 7.

5th Step: The hooks 19 of the lower front board 32 are pulled upward (or downward in FIG. 2) so that they are disengaged from the bushings 36 of the side boards 4A and 4B. After the foregoing steps, the unit of the front board 3 and the bottom board 41 can be removed from the organ body 2.

6th Step: The knobs 69 of the back board lock units 65 are pulled in the leftward direction of FIG. 10 so that the bolts 67 are pulled forward against the forces of the springs 68 to release their engagement with the engagement openings 57*a* and 57*b* of the back board rail 56 thereby to pull up the lower back board 52.

7th Step: Then, the upper back board 51 is pulled upward. Thus, the units of the back board 5 can be removed from the organ body 2.

8th Step: The side boards 4A and 4B are folded into below the organ body 2, as shown in the double-dotted lines of FIG. 7.

In these ways, the instrument 1 is disassembled into the four units, i.e., the unit of the main body 2 and the side boards 4A and 4B, the unit of the front board 3 and the bottom board 41, the unit of the upper back board 51 and the unit of the lower back board 52. In case, on the other hand, the instrument once disassembled is to be assembled again, it is sufficient to follow the reverse steps to the aforementioned disassembling procedures. As a result, the bulk of the package during transportion can be so reduced that the transportation efficiency can be remarkably improved in comparison with a conventional instrument which cannot be easily disassembled. Since, moreover, the front board 3, the back board 5 and the bottom board 41 are assembled with the main body 2 and the side board 4A and 4B without any use of screws or the like, the assembling and disassembling work can be remarkably easily carried out without requiring any tools such as screw drivers. Since, moreover, no parts such as screws are used, there is no fear of losing parts during the assembling and disassembling.

It should be understood that the present invention is not limited to the embodiment described thus far but can be applied and modified in various manners. Although the aforementioned embodiment is directed to the case, in which the side board 4A and 4B are connected in a folding manner to the main body 2 through the hinges 43 and 44, the present invention should not be limited thereto but can be extended to a modification, in which the connections are made in a removable manner by means of a known clamp mechanism, a latch or the like. For instance, there is shown in FIG. 11 another embodiment, in which dovetail joints are used to connect the side boards and the main body. That is, a member 70 formed with a dovetail groove is adhered or fixed by means of screws or adhesive to the bottom side of the main body 2, and the side board assembly 4A is formed at its upper end with such as protrusion having an inverted frustum shape as can be fitted in the dovetail groove 70*a*. When such construction is adopted, the attachment and detachment of the side boards can be detachably fixed to the main body.

On the other hand, although in the foregoing embodiment the upper and lower back boards 51 through 52 are removably jointed by means of the joint 53 having a cross-section of letter "H", they may be made integral or connected in a folding manner by means of hinges similar to the structure of the front board 3.

Moreover, the upper and lower front boards 31 and 32 may be constructed as a single board so that it can be upwardly pulled out of the body 2 like the back board 5 when the instrument is turned upside down.

Still further, although the foregoing embodiment is constructed such that the inner sides of the side boards 4A and 4B have the engagement portion 55 formed in a shape of an elongated groove, with which the both end portions of the back board 5 are slidingly engaged, a slide rail 80 may be fixed to the inner side of the side board 4A, as shown in FIG. 12, in order that a slider 81 secured on the back board 5 is slidingly received therein.

Furthermore, it is evident that the present invention need not be limited to the constructions, as exemplified in the foregoing embodiments, especially to construction of the connecting means such as the front board lock block unit, the lock blocks or the rear board lock unit. It is apparent that use of known latches or the like can fall within the scope of the present invention.

As has been described hereinbefore, the present invention is directed to a box-shaped keyboard musical instrument including the main body and the front, back and side boards for supporting the main body, which is so constructed that the front board and the back board are removably attached to the main body and the side boards as well, and these side boards are removably attached to the organ body or constructed to be folded down at the foot of the main body. As a result, assembling and disassembling of the instrument can be simplified to a great extent. Further, no fastening means requiring tools is used for assembling the instrument, so that the number of the parts can be reduced and fear of losing the parts during assembling and disassembling is obviated. Further, when the instrument is packed under its disassembled condition, its bulk is greatly reduced, so that the transportation efficiency can be remarkably improved and the handling in shipment is made much easier. On the other hand, although keyboard instruments of the combo type have gained wide acceptance in respect of band play use, the stationary type instrument embodying the present invention will be also accepted for such use since the stationary type keyboard instrument according to the present invention can be easily assembled or disassembled. This results in easy transfer of the instrument from place to place. In other words, the instrument according to the invention can be accepted by both people who prefer to use it at home and people preferring to use it for band play purpose.

What is claimed is:

1. A keyboard musical instrument housing designed for easy assembly and disassembly, said housing comprising a main body and a box-shaped leg portion for supporting said main body, said main body including a keyboard portion and an enclosure for housing electronic components to work in combination with said keyboard portion, said leg portion including a pair of laterally spaced parallel side boards for supporting said main body, mutually spaced front and back boards bridging said side boards and being arranged in laterally spaced parallel fashion and connecting means mounted at respective corners created between said boards constituting said leg portion, said connecting means including hinges for connecting said side boards to said main body so that said side boards are adapted to be folded in parallel with the underside of the main body, and spring biased locking means for connecting said front and back boards to said side boards, the front and back boards being detachably fixed to the main body and the side boards in cooperation with said spring biased locking means.

2. An instrument according to claim 1 wherein each of said hinges comprises a first and a second hinge member and a joint portion therebetween, each first hinge member having an L-shaped cross-section, and wherein those portions of said first hinge members, which are adjacent to the joint portions and which are arranged in contact and parallel with the inner sides of said side board portions, are made to have different lengths between those mounted to the two side boards.

3. An instrument according to claim 1 or 2, wherein said front board comprises an upper front board and a lower front board and further including hinges connecting said upper and lower front boards.

4. An instrument according to claim 3, further comprising an abutment member having a crank-shaped cross-section and being mounted to either of said upper and lower front boards in the vicinity of said hinges.

5. An instrument according to claim 3, further comprising a bottom board mounted between the lower portion of said lower front board and the lower portion of said back board, and first and second connecting members for connecting said bottom board to said lower front board and said back board respectively.

6. An instrument according to claim 3, wherein said upper front board has an upper end fitted in a guide formed in the bottom side of said main body, and wherein said lower front board is locked to said two side boards by means of said spring biased locking means, said spring biased locking means including hook connecting members.

7. An instrument according to claim 6, further comprising rotatable connecting members mounted between the lower portion of said lower front board and said two side boards for allowing said lower front board to swing back and forth.

8. An instrument according to claim 5, wherein said first connecting member is a hinge and said second connecting member includes a rail which is mounted on said back board and has a pair of opposing spring biased hooks arranged at a distance on said rail so as to hold said bottom board therebetween, and a guide formed in the lower side of said bottom board for receiving said rail.

9. An instrument according to claim 1, wherein said back board comprises an upper and a lower back board and a joint having an H-shaped cross section for joining said upper and lower back boards.

10. An instrument according to claim 9, further including a rail having a U-shaped cross-section and mounted on the lower portion of said lower back board, and wherein said spring biased locking means further includes spring-biased telescopic hooks provided on the lower portion of each of said side boards to engage said side boards with said lower back board at both ends of said rail.

11. An instrument according to claim 1, wherein said back board comprises an upper and a lower back board and a joint having an H-shaped cross-section for joining said upper and lower back boards, and said instrument further comprising a joint structure such that a guide formed at the bottom side of said main body receives the upper end of said upper back board, and a joint structure such that guides longitudinally formed on the respective opposing surfaces of side boards receive the sides of said upper and lower back boards.

12. An instrument according to claim 1, wherein there is provided a dovetail joint structure for connecting each of said side boards with said main body.

* * * * *